US006276794B1

(12) United States Patent
Chiang

(10) Patent No.: US 6,276,794 B1
(45) Date of Patent: Aug. 21, 2001

(54) SWIMMING GOGGLES

(76) Inventor: Herman Chiang, 11F-2 No 634-9 Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/652,765

(22) Filed: Aug. 31, 2000

(51) Int. Cl.[7] ..... G02B 1/00
(52) U.S. Cl. ..... 351/43; 351/116; 2/426
(58) Field of Search ..... 351/43, 41, 156, 351/157, 111, 116, 158; 2/426, 435, 436, 440, 441; D16/300–330, 101

(56) References Cited

U.S. PATENT DOCUMENTS 6,131,246 * 10/2000 Paulson et al. ..... 351/156

* cited by examiner

*Primary Examiner*—Hung Xuan Dang
(74) *Attorney, Agent, or Firm*—Pro-Techtor International Services

(57) ABSTRACT

A pair of swimming goggles, comprising a lens frame main unit, a protective pad, two lenses and a headband device, characterized in that: the lenses and protective pad of the swimming goggles are compressed tight to the lens frame main unit, the lens frame main unit has a frame with a central connector, and at least two openings on the frame, and an accommodating groove on the inside rim of the frame. The protective pad has a face contact part and a lens accommodating part, the face contact part serving to cover the upper part of the user's eyebrows and the lower part of the user's eye sockets, encompassing two eyes within a same single space, thereby providing a protective pad with the function of a face mask, so that the swimming goggles can resist water, and will not cause tight pressure on the user's eyeballs, and will provide wearing comfort and a wide field of vision.

12 Claims, 6 Drawing Sheets

SWIMMING GOGGLES

BACKGROUND OF THE INVENTION

1. Field of the Invention

This invention relates to a type of swimming goggles, or specifically an innovated structure of swimming goggles with a protective pad that encompasses two lens frames in one single space to provide wearing comfort and a wide view.

2. Description of Prior Art

The two lens frames of conventional swimming goggles, regardless of a wide variety of structural modifications, are designed to cover two eye sockets separately. In other words, the conventional design of swimming goggles has been aimed at preventing leak by covering the eye sockets. Therefore, whether sponge type or sucker type, the protective pads are designed as separate units on the lens frames. When the conventional swimming goggles are worn by the user's face, there will be a suction force applied by the protective pads around the eye sockets, which would result in a certain degree of discomfort after an initial period of use under water. Furthermore, because of the limited area of lens of conventional swimming goggles, the field of vision is quite limited. The most direct way to improve the drawback of narrow field of vision in conventional swimming goggles, of course, is to enlarge the lens frames. But the integral structural of the entire swimming goggles will be changed after the lens frames are enlarged. Then, wearing comfort will be a new problem to be solved.

BRIEF DESCRIPTION OF THE INVENTION

1. Objective of the Invention

The main objective of this invention of swimming goggles is to provide a type of swimming goggles with wearing comfort and extensive field of vision. With a protective pad that serves concurrently the function of a facemask, the swimming goggles will not cause pressure on the user's eyes, and will provide excellent prevention against leak by encompassing two lens frames in one space.

2. Characteristics of the Invention

This invention of swimming goggles is characterized in that: the lenses and protective pad of the swimming goggles are compressed to one unit with the lens frame main unit, wherein, the lens frame main unit comprises a frame that has a central connector, with at least two openings on the frame, and an accommodating groove on the inside rim of the frame.

Based on the above characteristic, the lens frame main unit is compressed and fixed to become a pressing member, the pressing member comprising: a bottom cover and a top cover that can be combined as one unit, wherein on opposite faces of the bottom cover and top cover are matching snappers and fasteners, and a positioning post that serves to accommodate the insertion and position a headband of the swimming goggles.

Based on the above characteristic, the central connector uses a rivet device to join the upper and lower rims of the lens frame main unit, the rivet device comprising a positioning unit on the frame and a rivet that is engaged with the positioning unit.

Based on the above characteristic, the lens frame main unit comprises a first frame, a second frame and a third frame that can be assembled as one unit, wherein the first frame has a central connector, while the two ends of the second and third frames can be respectively assembled to the pressing member. The positioning unit of the rivet device can be extended along with the central connector of the first frame, on which is a hollow shaft that serves to join the ends of the first and third frames, the hollow part of the hollow shaft serving to be fastened by the rivet, to fix the ends of the second and third frames to the central connector.

At the far ends of the first, second and third frames away from the central connector are openings that can be tightened to the bottom cover and top cover of the pressing member, the snappers and positioning post of the bottom cover and top cover serving to join the first, second and third frames by fixing the openings at their ends.

Yet another characteristic of this invention is that, the protective pad has a face contact part and a lens accommodating part, wherein the face contact part can cover the upper parts of eyebrows and lower parts of eye sockets, the lens accommodating part can accommodate the lenses before they are integrally accommodated in the first, second and third frames.

BRIEF DESCRIPTION OF DRAWINGS

The drawings of preferred embodiments of this invention are described in details as follows to enable better understanding.

BRIEF DESCRIPTION OF NUMERALS

| | | | |
|---|---|---|---|
| 1,1' | swimming goggles | 2,2' | lens frame main unit |
| 3 | protective pad | 4 | lens |
| 50 | rivet device | 51 | pressing member |
| 6 | headband device | 20,20' | first frame |
| 21,21' | second frame | 22 | third frame |
| 23 | accommodating groove | 201,201' | central connector |
| 202 | side connector | 210,220 | opening |
| 310 | depressed ring | 501 | positioning unit |
| 502 | rivet | 510 | bottom cover |
| 511 | top cover | 520,521 | snapper |
| 530,531 | fasteners | 540 | positioning post |
| 541 | stop face | 60 | headband |

DETAILED DESCRIPTION OF PREFERRED EMBODIMENTS

Figure 1:
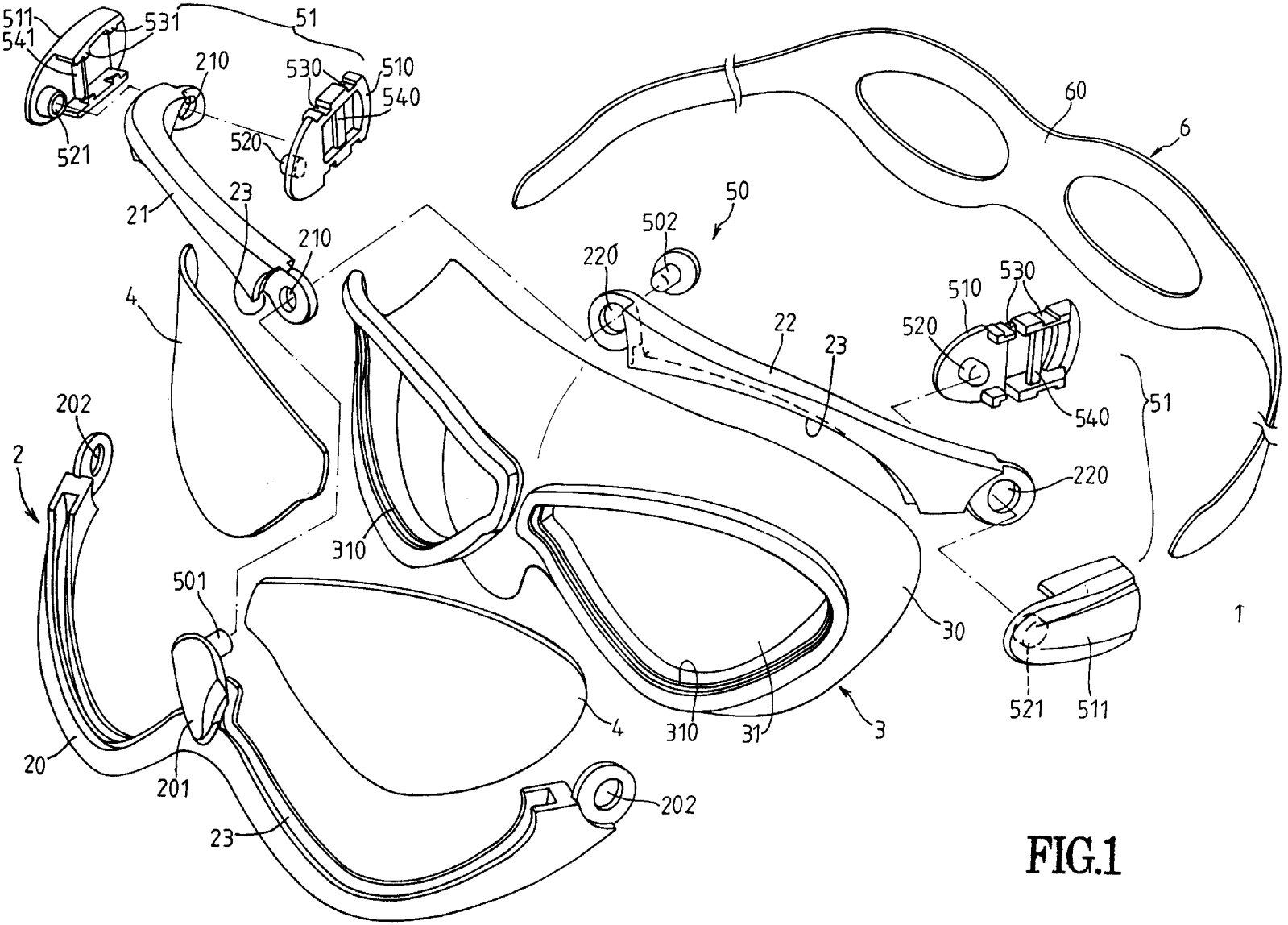
FIG. 1 is an exploded view of this invention.

As shown in FIG. 1, this invention of swimming goggles 1 comprises: a lens frame main unit 2, a protective pad 3, lenses 4, a rivet device 50, a compressing member 51 and a headband device 6, in which, the lens frame main unit 2 is composed of a first, a second and a third frame 20, 21 and 22, the first frame 20 is shaped like a "W", having a central connector 201 and two side connectors 202, the central connector 201 is an extension from the top of the center of the "W"-shaped frame, the two side connectors 202 are openings. The two ends of the second and third frames 21, 22 are respectively aligned to match with the central connector 201 and the two side connectors 202, the two ends of the two frames 21, 22 are openings 210, 220. On the insides of the first, second and third frames 20, 21, 22 are accommodating grooves 23 serving to accommodate the rims of the protective pad 3 and the lenses 4 (to be explained later).

The protective pad 3 has a face contact part 30 and a lens accommodating part 31. The face contact part 30 has a large area, its upper rim covering the part above the eyebrows, its lower rim covering the part below the eye sockets. The lens accommodating part 31 means the openings on the protective pad 3 to accommodate the lenses 4, and on the rims of the openings are depressed rings 310 to envelop the rims of the lenses before they are all accommodated in the accommodating groove 23 of the lens frame main unit 2.

The rivet device 50 and the pressing member 51 serve to fasten the first, second and third frames 20, 21, 22 as one unit The rivet device 50 comprises a positioning unit 501 and a matching rivet 502. The positioning unit 501 is a hollow shaft extending from the central connector 201 of the first frame 20, serving to join the matching openings 210, 220 of the second and third fiames 21, 22 and the central connector 201. The hollow part of the positioning unit 501 accommodates the rivet 201, to fasten the ends of the second and third frames 21, 22 to the central connector 201 of the first frame 20 as one unit. The pressing member 51 comprises a bottom cover 510 and a top cover 511 that can be snapped together as one unit. The bottom cover 510 and the top cover 511 have snappers 520, 521 and fasteners 530, 531 that can be engaged with each other, and a positioning post 540, in which the snapper 520 is a shaft shape and the matching snapper 521 is a hollow shape, the shaft-shaped snapper 520 fastens the openings 210, 220 at the ends of the second and third frames 21, 22, and the openings 202 at two sides of the first frame, and penetrate and fasten them with the hollow snapper 521 into one unit. The fasteners 530, 531 are a depressed groove and a protruded jut respectively at the bottom cover 510 and the top cover 511, the fasteners 530, 531 can be fastened together to tighten the bottom cover 510 and the top cover 511 tightly as one unit. The positioning post 540 is installed on the inside of the bottom cover 510, providing a space to accommodate the insertion of a headband 60 of the headband device 6. On the inside of the top cover 511 is a stop side, serving to restrict excessive insertion of the headband 60; when the headband 60 is attached after the bottom cover 510 and the top cover 511 are combined, the headband 60 running through the space between the bottom cover 510 and the top cover 511 is stopped by the stop side 541 to run in reverse direction through the space provided by the positioning post 540, so the headband 60 can be assembled.

Figure 2:
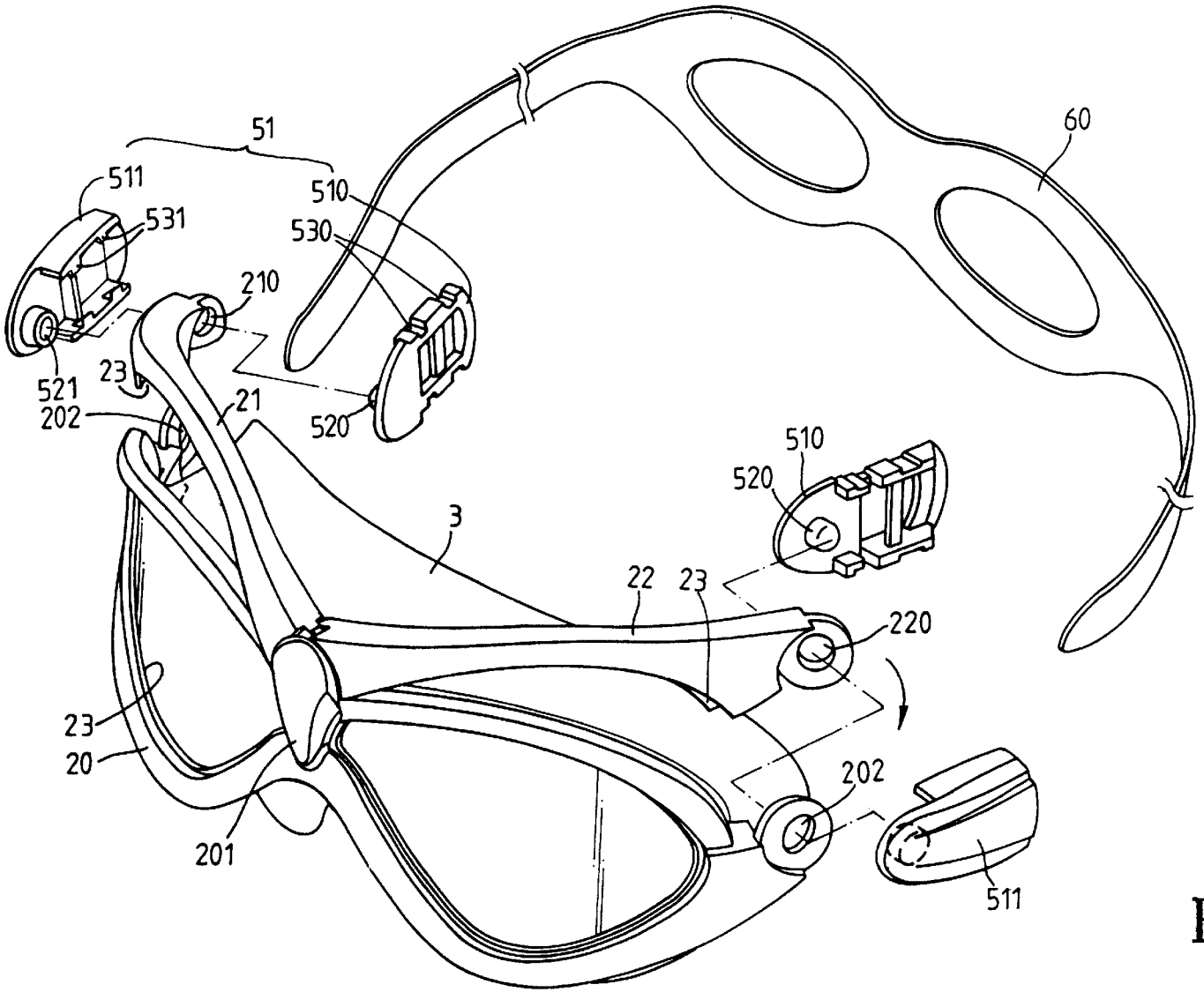
FIGS. 2 and 3 are the perspective views of assembling processes of this invention.
Figure 3:
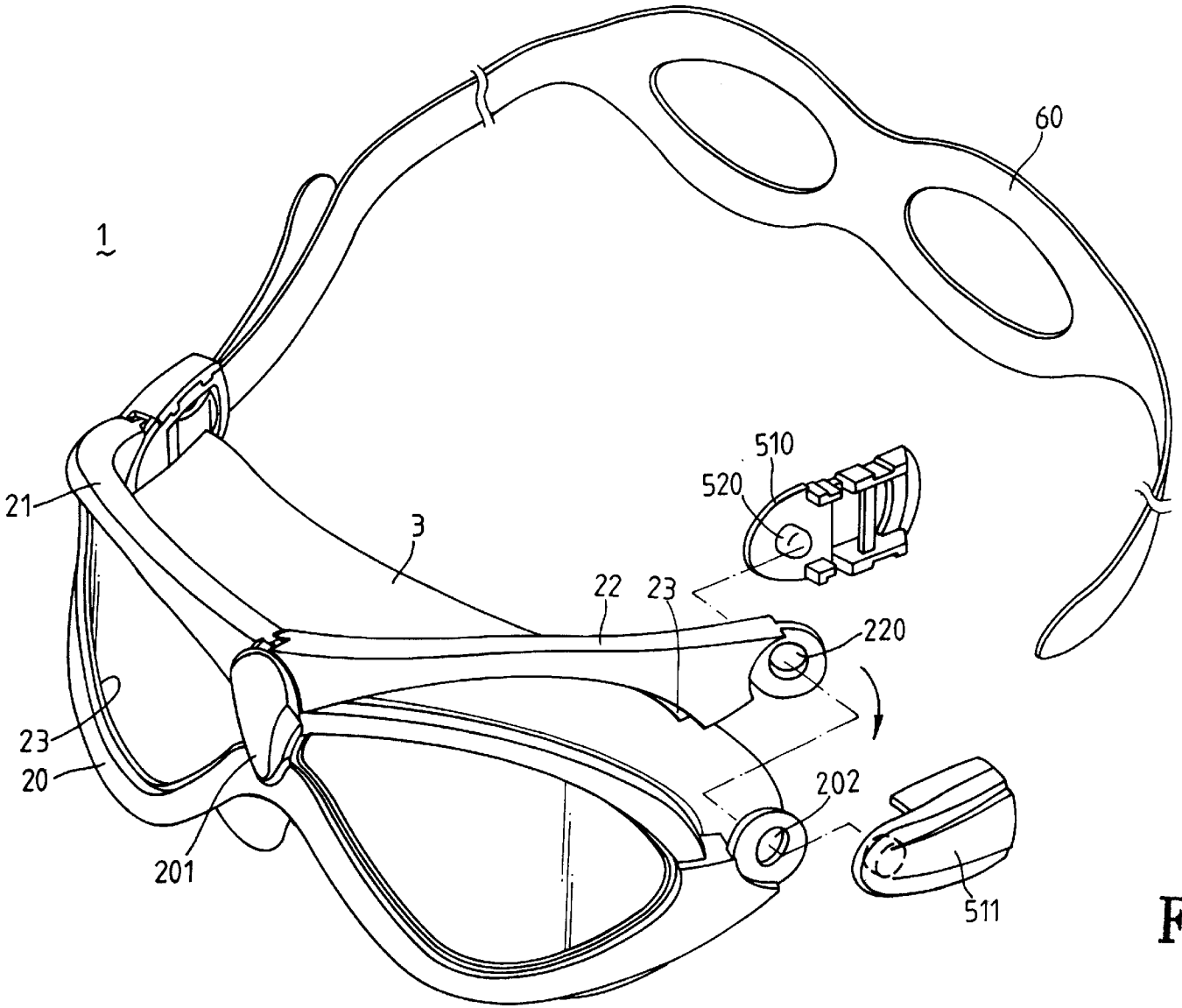

As shown in FIGS. 2 and 3, the way this invention of swimming goggles 1 are assembled is that, the lenses 4 are installed in the accommodating parts 31 of the protective pad 3, then the assembled lenses 4 and the protective pad 3 are respectively assembled to the accommodating grooves 23 on the first frame 20, then the openings 210, 220 of the second and third frames are mounted onto the positioning unit 501, and riveted by the rivet 502 to the hollow part of the positioning post 501, as shown in FIG. 2, the central ends of the second and third frames 21, 22 are positioned. Then, the accommodating groove 23 of the second frame 21 is pressed onto the upper rims of the protective pad 3 and the lens 4, then one side of the bottom cover 510 and the top cover 511 are combined by the insertion of the headband 60, and this side of the first frame 20 and the second frame 21 are assembled as one unit, as shown in FIG. 3. Then, likewise, one end of the third frame 22 is pressed by the accommodating groove 23 to the protective pad 3 and the lens 4, the opening 22 of the third frame 22 is aligned to the opening 202 at the other end of the first frame 20, and by fastening the snappers 520 and 521 and fasteners 530 and 531 on the bottom cover 510 and the top cover 511, the third frame 22 and the first frame 20 on this side are assembled as one unit, meanwhile, the entire lens frame main unit will securely fasten the protective pad 3 and the lenses 4. Finally, one end of the headband 60 is pulled through the positioning post 540 of the bottom cover 510 to assemble the first, second and third frames 20, 21, 22 and the protective pad 3, the lenses 4, and the headband 60 (shown in FIG. 4). Therefore, the entire assembling processes are completed by snapping devices to enable simplified operation, and the operational processes are not subjected to the restriction on specified production processes, so the production efficiency can be enhanced.

Figure 4:
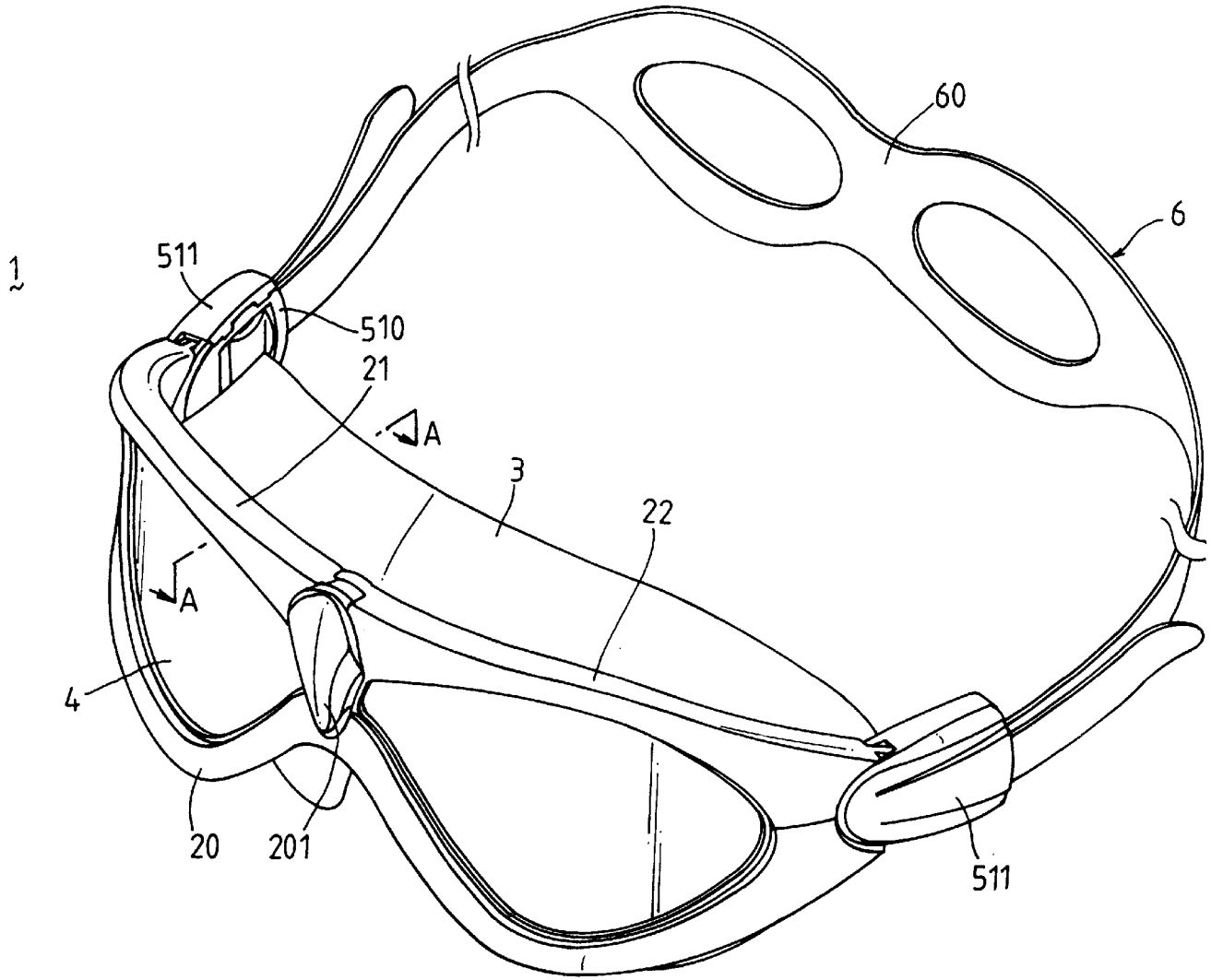
FIG. 4 is a perspective view of this invention.
Figure 5:
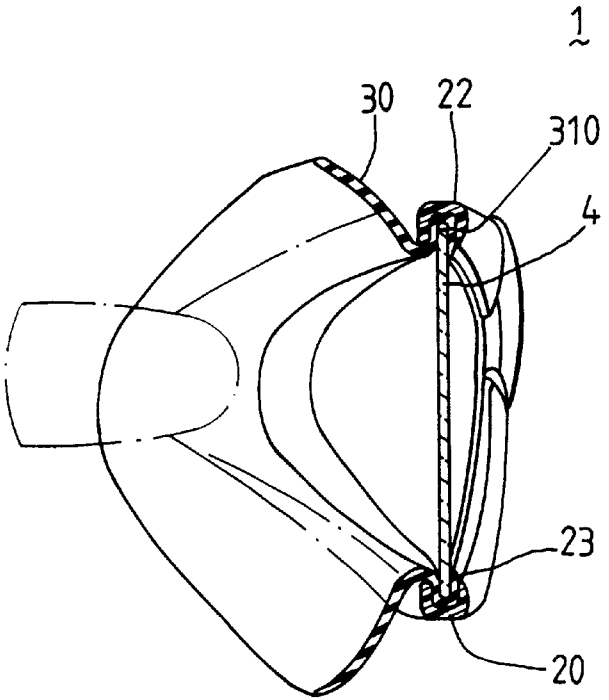
FIG. 5 is a section view taken from the line marked A—A in FIG. 4.

As shown in FIG. 5, which is a section view of FIG. 4, because the rims of the protective pad 3 and the lenses of this invention are securely fastened by the accommodating groove 23 of the first, second and third frames 20, 21, 22, there will be excellent leak-preventive efficiency.

Figure 6:
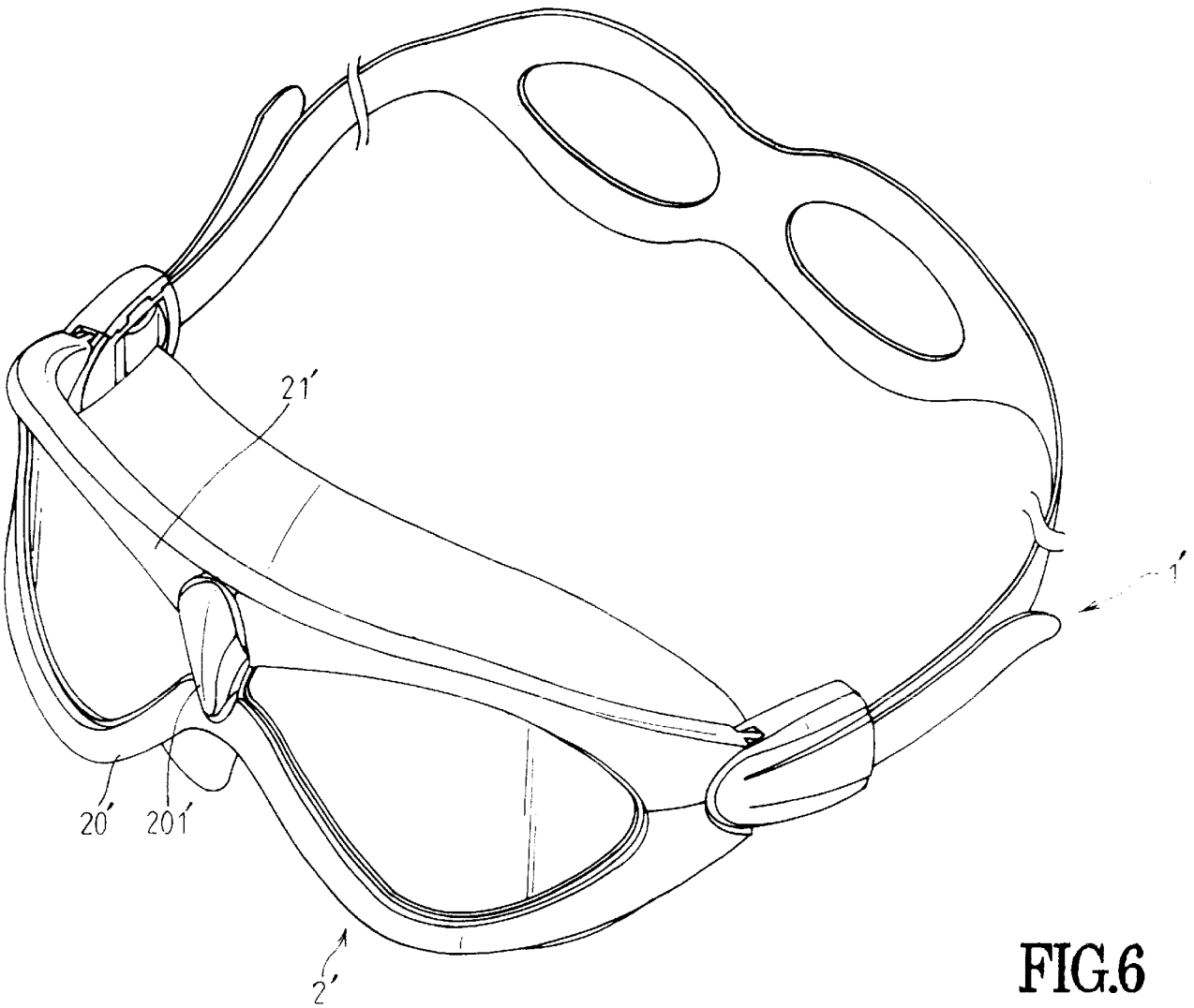
FIG. 6 is a second embodiment of this invention.

As shown in FIG. 6, which is a view of the second embodiment of this invention, the lens frame main unit 2' of the swimming goggles 1' is composed of the first and second frames 20', 21'. The difference in this embodiment is that, when the lens frame main unit is composed of two frames, the central connector 201' can be integrally connected to the upper and lower rims of the first and second frames 20', 21'. Other components remain the same as the first embodiment.

To conclude, while the preferred embodiments of this invention have been shown and described, it will be apparent to those skilled in the art that changes and modifications may be made therein without departing from the spirit of the invention, the scope of which is defined by the appended claim.

What is claimed is:

1. Swimming goggles, comprising:

a lens frame main unit, comprising a frame with a central connector at its center part, an accommodating groove at the inside rim of the frame, and at least two openings on the frame where the accommodating groove is located;

a protective pad, having a face contact part and a lens accommodating part, the face contact part being used to cover the upper part of eyebrows and the lower part of eye sockets;

two lenses, to be accommodated in the lens accommodating part of the protective pad, before they are to be accommodated in the accommodating groove of the lens frame main unit; and a pressing member, located at the opening of the frame of the lens frame main unit, comprising: a bottom cover and a top cover that can be combined as one unit, on opposite locations on the bottom cover and the top cover being snappers and fasteners that can be fastened together, and positioning posts to facilitate the insertion of the headband.

2. The swimming goggles as claimed in claim 1, wherein the central connector of the lens frame main unit uses a rivet device to join the upper and lower rims of the lens frame main unit, said rivet device including a positioning unit on the frame, and a rivet that can be combined with the positioning unit.

3. The swimming goggles as claimed in claim 2, wherein said lens frame main unit comprises a first frame, a second frame and a third frame that can be assembled as one unit, said first frame having said central connector, while the two ends of the second and third frames can be respectively assembled with a pressing member.

4. The swimming goggles as claimed in claim 3, wherein the positioning unit of the said rivet device is an extension from the central connector on said first frame, on which is a hollow shaft to join one ends of the second and third frames, the hollow part of said hollow shaft can be inserted by said rivet, to fasten the one ends of the second and third frames to the central connector of the first frame.

5. The swimming goggles as claimed in claim 4, wherein at the ends of said first, second and third frames away from the central connector are openings serving to fasten the bottom cover and top cover of the pressing member, the snappers and positioning post of the bottom cover and top cover will fasten the openings of the first, second and third frames as one unit.

6. The swimming goggles as claimed in claim 5, wherein on the inside of the top cover of the pressing member is a stop side to restrict excessive insertion of the headband, said stop side.

7. The swimming goggles as claimed in claim 6, wherein on the bottom cover and top cover of said pressing member are snappers that serve to combine the two parts, said snappers having a depressed groove and a protruded jut respectively on the bottom cover and the top cover.

8. Swimming goggles, comprising:

a lens frame main unit, composed of a first frame and a second frame, at its center being a central connector serving to join the upper and lower rims of the frames, and, on the inside of the frame being an accommodating groove, and on the frame where the accommodating groove is located being an opening;

a protective pad, having a face contact part and a lens accommodating part, the face contact part being used to cover the upper part of eyebrows and the lower part of eye sockets;

two lenses, to be accommodated in the lens accommodating part of the protective pad, before they are to be accommodated in the accommodating groove of the lens frame main unit;

a pressing member, located at the opening of the frame of the lens frame main unit, comprising: a bottom cover and a top cover that can be combined as one unit, on opposite locations on the bottom cover and the top cover being snappers and fasteners that can be fastened together, and positioning posts to facilitate the insertion of the headband; and a headband device, comprising at least a headband, located at two sides of the lens frame main unit.

9. The swimming goggles as claimed in claim 8, wherein the central connector of the lens frame main unit uses a rivet device to join the upper and lower rims of the lens frame main unit, said rivet device including a positioning unit on the frame, and a rivet that can be combined with the positioning unit.

10. The swimming goggles as claimed in claim 9, wherein at the ends of said first, second and third frames away from the central connector are openings serving to fasten the bottom cover and top cover of the pressing member, the snappers and positioning post of the bottom cover and top cover will fasten the openings of the first and second frames as one unit.

11. The swimming goggles as claimed in claim 10, wherein on the inside of the top cover of the pressing member is a stop side to restrict excessive insertion of the headband, said stop side.

12. The swimming goggles as claimed in claim 11, wherein on the bottom cover and top cover of said pressing member are snappers that serve to combine the two parts, said snappers having a depressed groove and a protruded jut respectively on the bottom cover and the top cover.

* * * * *